United States Patent [19]

Mezger

[11] 3,943,992

[45] Mar. 16, 1976

[54] CONTROLLED-POURING APPARATUS FOR METAL CASTING

[75] Inventor: Fritz Mezger, Murten, Switzerland

[73] Assignee: Maschinenfabrik & Eisebgiesserei Ed. Mezger AG, Kallnach, Switzerland

[22] Filed: Feb. 6, 1975

[21] Appl. No.: 547,505

[30] Foreign Application Priority Data

Nov. 29, 1974 Germany ..... 2456604

[52] U.S. Cl. ..... 164/156

[51] Int. Cl.[2] ..... B22D 1/02

[58] Field of Search ..... 164/156

[56] References Cited

UNITED STATES PATENTS

| | | | |
|---|---|---|---|
| 1,469,224 | 10/1923 | Lodd | 164/156 X |
| 2,548,696 | 4/1951 | Borstow et al. | 164/156 X |
| 2,741,006 | 4/1956 | Kux | 164/156 |
| 3,188,704 | 6/1965 | Sukawa | 164/156 |
| 3,353,586 | 11/1967 | Dressel | 164/156 |
| 3,378,061 | 4/1968 | Von Alt et al. | 164/156 |
| 3,591,052 | 7/1971 | Nef | 164/156 X |
| 3,659,644 | 5/1972 | De Bie | 164/156 X |
| 3,692,091 | 9/1972 | Saxer | 164/156 |

FOREIGN PATENTS OR APPLICATIONS

| | | | |
|---|---|---|---|
| 2,108,000 | 9/1971 | Germany | 164/156 |

*Primary Examiner*—Ronald J. Shore
*Attorney, Agent, or Firm*—McNenny, Farrington, Pearne & Gordon

[57] ABSTRACT

An apparatus for an installation in which molten metal is poured in a mold comprises a sensor movable upwardly and downwardly by means of a servomechanism automatically controlled by electric circuit means so that, when pouring has begun, the lower end of an electric sensor follows the surface level of the metal in the pouring gate of the mold. A control device is operated in dependence with the movements of the sensor for causing the metal to be poured as a function of the surface level in the pouring gate.

5 Claims, 1 Drawing Figure

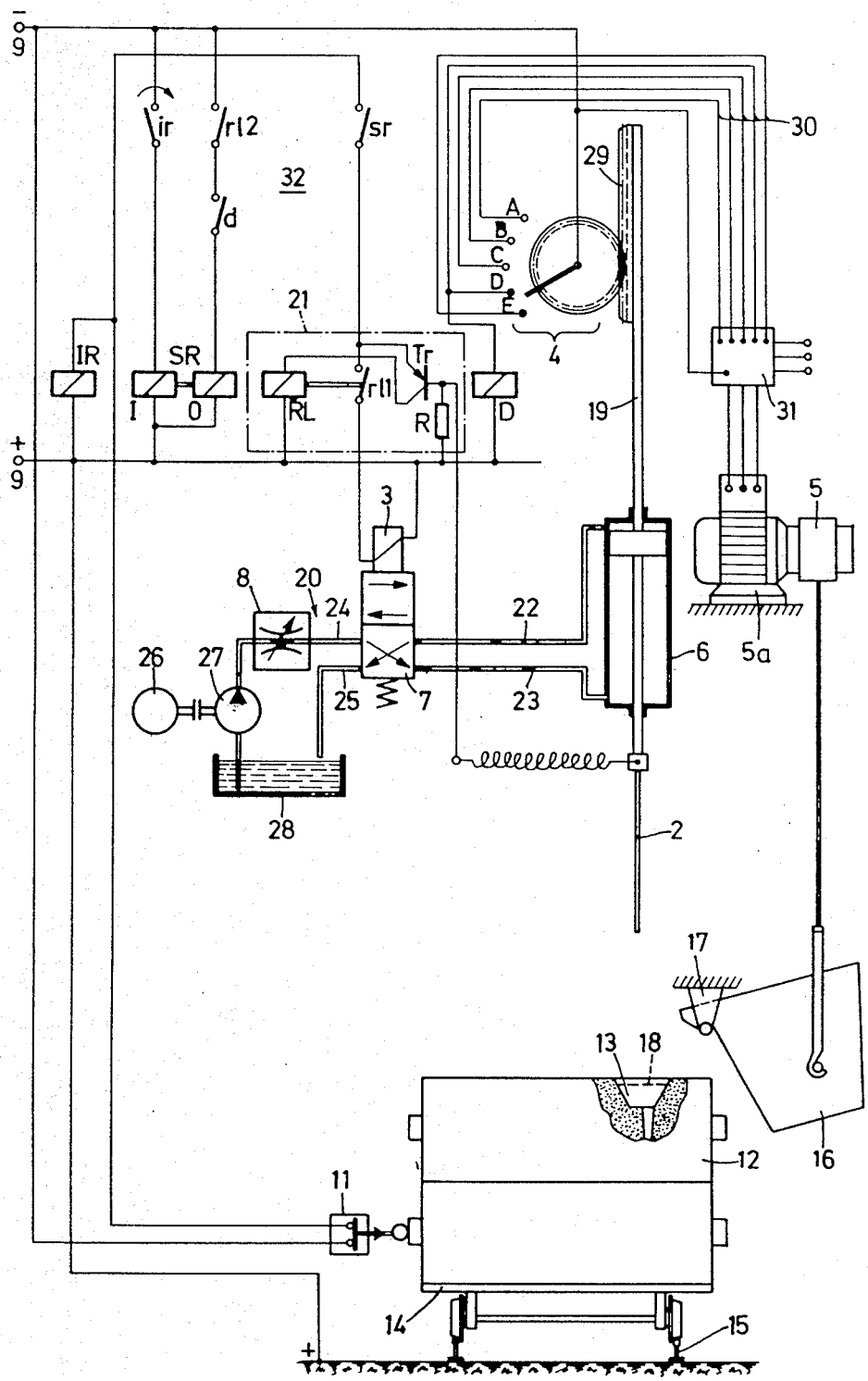
9
ir
rl2
sr
32
d
30
29
A
B
C
D
E
4
21
IR
SR
I
0
RL
rl1
Tr
R
D
19
31
9
3
5
8
20
24
22
26
27
25
7
23
6
5a
28
2
17
13
18
12
16
11
14
15

CONTROLLED-POURING APPARATUS FOR METAL CASTING

This invention relates to an apparatus for a casting installation, for controlled pouring of molten metal during casting in a movable mold having a pouring gate, comprising a receptacle for the molten metal and a sensor having a lower end, the sensor being movable from a resting position, in which it is situated outside the range of movement of the mold at the location provided for pouring, into an operating range, in which its lower end projects into the pouring gate.

Various kinds of controlled-pouring apparatus are already known, e.g., such as are designed to supply a predetermined quantity of molten metal to the mold; other are so designed that the speed at which the metal flows out of the bottom opening of a ladle is controlled as a function of the metal contained in the ladle; cf. German Published Application No. 1,297,827, for example. However, none of these apparatus reacts directly to the ingestion capacity of the mold.

This capacity varies not only from one pattern to another, but also in some cases during a single casting operation, namely, when several different parts are formed in one mold and fill up successively during casting, for instance. The ingestion capacity of the mold is furthermore dependent upon the viscosity of the metal, i.e., its temperature, upon the pouring height, and upon the permeability of the mold sand to gas. It quite clearly follows that the pouring rate must continuously be adjusted to the ingestion capacity of the mold at each particular moment in order to ensure faultless automatic casting. Hence the so-called automatic pouring apparatus which are already known and which work at a predetermined pouring rate or with a predetermined quantity of metal can be used only in mass-production, where the necessary data can be experimentally determined in advance. Those conditions which still vary nontheless can be taken into consideration only to an insufficient extent. Despite other undeniable advantages, therefore, these casting methods are plainly inferior in the quality of the casting to manual casting by a founder. Besides that, most of these automatic pouring apparatus are very expensive, so that they are uneconomical to use except in a very limited number of cases.

Whenever casting has been done by hand, every effort has always been made to carry out the pouring operation in such a way that the pouring gate of the mold is continuously kept full. This is important because, for one thing, it keeps the slag floating on the molten metal from reaching the cavities and recesses of the mold, and for another thing, it ensures that the highest possible casting speed is achieved, thus saving time and allowing casting at a minimum temperature.

This calls for a great deal of experience and care on the part of the founder, whose attentiveness tends to be impaired by aggravating external circumstances such as heat, spattering metal, etc. Moreover, when working at high speeds, the founder often reacts too slowly even when the pouring gate is large, so that waste and rejects occur, or a great deal of metal overflows, and the consequences are accordingly disadvantageous and more or less costly.

It is therefore the main object of this invention to provide a further development of a casting installation of the afore-mentioned kind, and to do so with a comparatively limited and thus inexpensive amount of construction, so that the pouring gate will automatically be kept full during the entire casting operation, and pouring will also be stopped automatically at the end of the operation, and so that the pouring apparatus is to a great extent independent of the pouring-rate and the quantity of metal, whereby automatic casting becomes possible for a varying production program as well, and the quality of casting obtainable manually can be equalled or surpassed.

To this end, the apparatus according to the present invention further comprises a servomechanism, electric circuit means including the sensor, motor means, and a control device including means for supporting the sensor, the servomechanism being automatically controlled by the circuit means for moving the sensor up and down within its operating range and, after pouring has begun, for causing its lower end to follow up the surface level of the molten metal in the pouring gate and thus intermittently to effect short-stroke up-and-down movements with respect to that surface level so as to be alternately in and out of electrically conductive contact with the metal in the pouring gate, and the motor means being controlled by the control device for causing the metal to be poured from the receptacle into the pouring gate as a function of the level of metal sensed in the pouring gate by the sensor.

The aforesaid design makes it possible to ensure that the pouring gate is kept full as desired, with the attendant advantageous consequences, more certainly than in the case of manual pouring. There is no longer any dependence upon the full attention and consistently rapid reaction of the founder; there are fewer rejects, and accidents during pouring can be avoided much more easily. It is possible to cut down on personnel, and working conditions are made easier; at the same time, the output of the casting installation equipped with the apparatus can be considerably increased. The pouring gate can be made smaller and the runner material thereby reduced, which in itself is often already enough to guarantee the economical operation of this automatic apparatus. Overflowing metal, and thus injuries to personnel and damage to equipment, as well as the cost of such metal, are avoided.

A pouring apparatus taught by German Disclosed Application No. 2,108,000 likewise operates with a movable sensor which, however, forms part of a filling-level indicator device that starts and stops the pouring operation but does not control it in any way. Filling-level indicators with sensors are quite generally known in a number of instances in connection with automatic continuous casting installations.

As may be gathered from German Published Application No. 1,138,891 and U.S. Pat. No. 2,290,083, for example, the pouring of molten metal into the billet mold, or rather into an intermediate basin coming before the billet mold, has been controlled for many years now in continuous casting machines by means of a servomechanism controlled by a stationary sensor in such a way that the surface of the molten metal in the basin always remains at substantially the same level.

This system is very sluggish in operation because it relays only two commands to the pouring apparatus, viz., "tilt ladle" and "cease tilting ladle". The two prerequisites for the functioning of this method are a large pouring basin and a mold which remains the same for relatively large production series, so that the system may be adjusted accordingly.

The conditions are quite different in the case of casting in box molds. The flow-rate may change from one mold to the other and may even change very considerably within one mold. The pouring gate is very much smaller in relation to the rate of pouring, which is why the system for continuous casting would be totally unusable for automatic pouring into the usual box molds.

One possible embodiment of the present invention provides that the servomechanism comprises a double-acting hydraulic piston-and-cylinder unit and an electromagnetically operatable selector valve controlled by the circuit means for alternately injecting pressure fluid into one or the other of the chambers of the hydraulic piston-and-cylinder unit; the servomechanism then preferably comprises an adjustable throttling member connected in before the reversing shutoff device, thus making it possible to cause the servomechanism to respond more or less quickly to changes in the level of the molten metal in the pouring gate of the mold.

A preferred embodiment of the invention will now be described in detail, by way of example, with reference to the accompanying drawing, the sole FIGURE of which is a diagram of the aforementioned embodiment.

A dolly 14 is adapted to travel on rails 15 so that a mold 12 may be set upon it and moved into a suitable position for casting.

A ladle 16 containing the molten metal to be poured can be tilted about a pivot point 17 by means of an electric chain hoist 5, which may either have two fixed speeds or be continuously variable in speed. Casting installations of this kind are well-known.

The present invention relates more particularly to an apparatus for the controlled pouring of the molten metal from the ladle 16 into the mold 12 in such a way that during the entire casting operation, the surface level 18 of the molten metal is kept in a pouring gate 13 of the mold 12 with as little variation as possible in order to prevent the slag floating on top of the metal from reaching the cavities of the mold proper.

This apparatus comprises a sensor 2 in the form of a vertical, electrically conductive rod, the upper end of which is insulatingly fastened in the bottom portion of a pistonrod 19, movable up and down vertically, of a hydraulic piston-and-cylinder unit 6. The unit 6 forms part of a servomechanism, designated as a whole by the reference numeral 20, which is automatically controlled by electric circuit means 21, to which the sensor 2 belongs.

The primary task of the servomechanism 20 is to move the sensor 2 up and down within its operating range in such a way that after pouring has begun, the lower end of it follows up the surface level 18 of the molten metal in the pouring gate 13 and, in so doing, intermittently executes short-stroke up-and-down movements so as alternately to dip into the metal and be withdrawn from it. After casting has been completed, i.e., when the surface level 18 in the pouring gate 13 has reached a maximum height, the servomechanism 20 also serves to lift the sensor 2 up into a resting position in which it can in no case hinder the removal of the mold 12 to be rolled away on the dolly 14.

In the servomechanism 20, the piston-and-cylinder unit 6 is connected to a pump 27, driven by an electric motor 26, and to a reservoir 28 containing the operating fluid, by means of pipelines 22, 23 24 and 25 of an electromagnetically operatable selector valve 7. In the pipeline 24 leading away from the pump 27, an adjustable throttling valve 8 is inserted. The solenoid of the selector valve 7 is inserted in the circuit means 21. In addition to the sensor 2 and a power source 9, the circuit means 21 also comprise a push-button switch 11 which is closed by the molding box 12 when the latter is exactly in the pouring position. Details of the circuit means 21 will be described below, together with the resultant automatic mode of operation of the apparatus whereby the sensor 2 is lifted all the way up into a resting position when a maximum level is reached in the pouring gate 13, and is not moved down again into its operating range until after a filled mold has been carried away and replaced by an empty mold in the pouring position.

The apparatus also comprises a device, designated as a whole by the reference numeral 26, of which the piston-rod 19 supporting the sensor 2 forms part, for controlling the motor means, consisting in this embodiment of the chain hoist 5 and the associated drive motor **5*a*, for tilting the ladle 16 containing the molten metal over and back as a function of the level of molten metal sensed in the pouring gate 13 by the sensor 2. This device 26** may obviously take any one of a number of different forms.

In the embodiment illustrated, the piston-rod 19 bears at the top a rack 29 which is drivingly connected by means of a cog-wheel to an electrical transmitter (rotary switch) 4 which thus transmits a control signal, corresponding to the position of the sensor 2 in the vertical sense, over a signal line 30 to a conventional direction-of-rotation and speed-of-rotation control device 31 of the motor **5*a***.

Sensor-Control

The normal position is as follows: a coil 3 of the selector valve 7 is not energized and thus keeps the sensor 2 in its uppermost position. This position of the sensor 2 is registered by the switch 4, which occupies position E. This makes it possible to move the molding box 12 since the sensor 2 does not project into the pouring gate 13.

The apparatus operates as follows: after one box has been moved away, a new one comes into pouring position. The switch 11 is closed. A starting impulse relay IR, by means of its contact, switches into circuit a locking relay SR which, in turn, connects the negative pole of the power source 9 to the base of a transistor Tr via a resistor R. The transistor Tr causes a relay RL to attract, whereby the selector valve 7 reverses. The sensor 2 is then lowered into the gate 13. The switch 4 now occupies position A, which brings about the rapid tilting of the ladle 16. The molten metal flows into the pouring gate 13 and thus creates a direct connection between the sensor 2 and ground, which is connected in turn to the positive pole of the power source 9. Even though this is a very "poor", i.e., high-impedance connection, it nevertheless suffices to make the potential at the transistor base positive and to make the transistor Tr itself non-conductive. The relay RL drops out, and the selector valve 7 is reversed by spring tension. The sensor 2 rises until it no longer has any connection to the metal in the pouring gate 13. Immediately, the above-described operation is repeated. This tip of the sensor 2 constantly oscillates with short-stroke movements about the level in the pouring gate 13, wherever it may be at any given moment. As this takes place, that level is constantly registered by the switch 4. After pouring has started, the level of the molten metal rises. The sensor 2 leaves the lowest position A, the result of which is that the tilting speed of the ladle 16 is thenceforth slower. If the level rises to position B, tilting is stopped completely until the moment when the level again falls below B. This operation (level below B and above B) may be repeated a number of times. If too much metal flows out of the ladle 16, and if the surface of the metal rises to level C, the ladle 16 is caused to swing back so that the pouring stream becomes smaller, and the too-high level in the pouring gate may sink again. When the mold 12 is full, the surface level of the metal in the pouring gate 13 suddenly rises since no more metal can flow out. As a result, the sensor 2 rises, and the switch 4 assumes position D. The ladle 16 is thereby swung upright via a time-lag relay so that no more metal can flow out.

The casting operation is now terminated. When the level D is reached, a relay D attracts and, together with the pulse of a contact r12, cuts the locking relay SR out again. Immediately, the coil 3 of the selector valve 7 is then no longer energized. The piston-rod 19 with the sensor 2 goes back into the uppermost position. The prerequisite for rolling the molding box 12 away is once more met. The same pouring operation is not recommenced until a new molding box again operates the terminal switch 11.

It will be understood that a great variety of changes might be made in the example of an embodiment described. For instance, if another type of motor 5*a* were provided, the control device 26 might obviously comprise a potentiometer, for example, which would trigger a conventional thyristor control for the various rapid back-and-forth rotations.

Instead of being a tilting lip-pour ladle, the ladle 16 might be designed as a bottom-pour ladle. In that case, the chain hoist might be replaced by a worm gear with a screw-spindle movable up and down; the screw spindle, provided with a stopper at its lower end, would close off completely or free to a greater or lesser extent an opening in the bottom of the ladle for the purpose of varying the rate of molten metal flowing out of the ladle into the mold. In the case of a hydraulically operated pouring apparatus, the hydraulic valve might equally well be controlled via the sensor control.

What is claimed is:

1. An apparatus for a casting installation, for controlled pouring of molten metal during casting in a movable mold having a pouring gate, comprising a receptacle for said metal and a sensor having a lower end, said sensor being movable from a resting position, in which it is situated outside the range of movement of said mold at the location provided for pouring, into an operating range, in which said lower end projects into said pouring gate, and further comprising a servomechanism, electric circuit means including said sensor, motor means, and a control device including means for supporting said sensor, said servomechanism being automatically controlled by said circuit means for moving said sensor up and down within said operating range and, after pouring has begun, for causing said lower end to follow up the surface level of said metal in said pouring gate and thus intermittently to effect short-stroke up-and-down movements with respect to said surface level so as to be alternately in and out of electrically conductive contact with said metal in said pouring gate, and said motor means being controlled by said control device for causing said metal to be poured from said receptacle into said pouring gate as a function of said surface level sensed in said pouring gate by said sensor.

2. An apparatus in accordance with claim 1, wherein said servomechanism comprises a double-acting hydraulic piston-and-cylinder unit and an electromagnetically operatable selector valve controlled by said circuit means for alternately injecting pressure fluid into one or another chamber of said unit.

3. An apparatus in accordance with claim 2, wherein said servomechanism comprises an adjustable throttling member connected in before said selector valve.

4. An apparatus in accordance with claim 1, wherein said receptacle is a tilting lip-pour ladle adapted to be tilted over and back by said motor means.

5. An apparatus in accordance with claim 1, wherein said receptacle is a bottom-pour ladle having a stopper adapted to be raised and lowered by said motor means.

* * * * *